US006954030B2

(12) United States Patent
Kawase

(10) Patent No.: US 6,954,030 B2
(45) Date of Patent: Oct. 11, 2005

(54) IMAGE FORMING SUBSTRATE, ELECTRON-EMITTING SUBSTRATE AND IMAGE FORMING APPARATUS

(75) Inventor: Toshimitsu Kawase, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 10/751,933

(22) Filed: Jan. 7, 2004

(65) Prior Publication Data

US 2004/0135491 A1 Jul. 15, 2004

Related U.S. Application Data

(62) Division of application No. 10/233,604, filed on Sep. 4, 2002, now Pat. No. 6,703,779, which is a division of application No. 09/517,741, filed on Mar. 3, 2000, now Pat. No. 6,476,547.

(30) Foreign Application Priority Data

Mar. 5, 1999 (JP) ..... 11-058458

(51) Int. Cl.[7] ..... H01J 1/62; H01J 63/04

(52) U.S. Cl. ..... 313/495; 313/583; 313/634; 315/169.3; 345/76; 345/82

(58) Field of Search ..... 313/495, 583, 313/631, 634, 496, 477 HC, 461; 315/169.1, 169.3; 345/76, 82, 84

(56) References Cited

U.S. PATENT DOCUMENTS

| | | | | |
|---|---|---|---|---|
| 5,734,224 | A | 3/1998 | Tagawara et al. | 313/493 |
| 5,912,531 | A | 6/1999 | Hasegawa et al. | 313/495 |
| 5,936,343 | A | 8/1999 | Fushimi et al. | 313/495 |
| 5,986,389 | A | 11/1999 | Tsukamoto | 313/310 |
| 6,114,804 | A | 9/2000 | Kawase et al. | 313/495 |
| 6,494,429 | B2 | 12/2002 | Tajima | 248/473 |
| 6,528,939 | B1 | 3/2003 | Kawase | 313/495 |

FOREIGN PATENT DOCUMENTS

| | | |
|---|---|---|
| JP | 4-160741 | 6/1992 |
| JP | 4-163833 | 6/1992 |
| JP | 7-235255 | 9/1995 |
| JP | 10-326581 | 12/1998 |

*Primary Examiner*—Joseph Williams
*Assistant Examiner*—Kevin Quarterman
(74) *Attorney, Agent, or Firm*—Fitzpatrick, Cella, Harper & Scinto

(57) ABSTRACT

An image forming apparatus includes a first substrate on which a plurality of electron-emitting devices and drive wiring for driving the plurality of electron-emitting devices are arranged, and a second substrate on which an image forming member and lead wiring connected to the image forming member are arranged. The first and second substrates are disposed in opposition to each other, and the plurality of electron-emitting devices, the drive wiring, the image forming member and the lead wiring are disposed within an envelope which is formed between the first and second substrates. The lead wiring extends to a corner of the first substrate and is in contact with an electroconductive terminal, and the electroconductive terminal extends from a contact portion with the lead wiring toward the first substrate and is partially exposed outside of the envelope through an opening formed in the first substrate. In addition, a wiring of a defined potential is disposed between the opening and the driving wiring in the envelope.

2 Claims, 9 Drawing Sheets

IMAGE FORMING SUBSTRATE, ELECTRON-EMITTING SUBSTRATE AND IMAGE FORMING APPARATUS

This is a divisional application of application Ser. No. 10/233,604, filed on Sep. 4, 2002 now U.S. Pat. No. 6,703,779, which is a divisional of application Ser. No. 09/517,741, filed on Mar. 3, 2000, now U.S. Pat. No. 6,476,547, issued on Nov. 5, 2002.

BACKGROUND OF THE INVENTION

1. Field of the Invention

The present invention relates to an image forming apparatus utilizing an electron-emitting device.

2. Related Background Art

The cathode ray tube (CRT) has long been utilized as the image forming apparatus for displaying an image utilizing an electron beam.

On the other hand, the flat display device utilizing liquid crystal has recently become popular in place for the CRT, but such display device, being not light-emitting, is associated with a drawback of requiring a back light source, and the development of the display device of light-emitting type has therefore been longed for.

For such light-emitting display device, the plasma display device is being recently commercialized, but, being different from the CRT in the principle of light emission, is somewhat inferior to the CRT in the image contrast and the quality of the generated colors. Also a flat panel image forming apparatus utilizing a planar array of plurality of electron-emitting elements is expected to provide the light emission comparable to that of the CRT, and intensive researches and developments have been conducted in this field. For example the Japanese Patent Application Laid-Open No. 4-163833 discloses a flat panel electron beam image forming apparatus utilizing linear hot cathodes and complex electrode structures contained in a vacuum panel.

Such vacuum panel is generally formed by hermetically adhering a glass rear plate, bearing an electron source consisting of a matrix array of plural electron-emitting devices and wirings for driving such electron source, and a glass face plate bearing an image forming member, with a sealing material across a frame, or, in case the gap between the rear plate and the face plate is small, by directly adhering such rear plate and such face plate with a sealing material.

The sealing material is usually composed of low-melting glass, which requires, for softening, a heating process to a high temperature of about 400° C. In this operation, the face plate and the rear plate, as well as other components such as an atmospheric pressure supporting spacer required for constituting the vacuum panel and an anode terminal to be explained later, are exposed to the high temperature at the same time.

The interior of the panel prepared through the above-described process is rendered vacuum by an evacuating process to obtain the vacuum panel. Then, after a process of electrically connecting an external drive circuit with the lead wires formed on the rear plate, the vacuum panel is incorporated in a casing to complete the image forming apparatus.

In thus formed image forming apparatus utilizing the electron beam, while a voltage of several hundred volts to several ten kilovolts for accelerating the electrons is applied between the two glass plates (rear plate bearing the electron source and face plate bearing the image forming member), an image signal is supplied from an external signal processing circuit and through the lead electrodes of the rear plate to emit electrons in the desired position, whereby the emitted electrons are accelerated by the potential difference between the two glass plates and cause light emission from the image forming member of the face plate, thereby obtaining an image. In case the image forming member is composed of ordinary fluorescent material, the above-mentioned voltage is preferably as high as possible in order to obtain the light of desired colors, desirably at least several kilovolts. Therefore, in order to supply the above-described image forming member with the voltage of several kilovolts, there is required a connection structure designed in consideration of the discharge or high voltage.

Such image forming apparatus is provided, in the image forming member, with an anode lead portion for supplying the image forming member with the high voltage. For example the Japanese Patent Application Laid-Open No. 10-326581 discloses anode terminal structure in which a high voltage supplied from a high voltage generating source is supplied by a high voltage cable to an anode lead portion of the rear plate side, then supplied through a lead wire to a wiring lead from the image forming member formed on the face plate and to such image forming member.

Such image forming apparatus has been associated with the drawbacks that:

1. no place is available for forming the anode lead portion;
2. a single lead portion results in a sloped luminance, leading to unevenness in the image, in case of a large area panel; and
3. a thin image forming apparatus of flat panel type involves danger of discharge because the distance between the image forming member and the electron source along the internal wall of the vacuum envelope becomes short. The discharge, if generated, involves an instantaneously very large current, and a large voltage is applied to the electron-emitting device of the electron source if a part of such current flows into the wirings of the electron source. If such voltage exceeds that applied in the normal operation, there may result deterioration of the electron-emitting characteristics, of eventually destruction of the electron-emitting device. In such case, a part of the image becomes undisplayable, whereby the image quality is severely deteriorated and the image forming apparatus becomes no longer usable.

For these reasons, there has been desired a large-area electron beam image forming apparatus of high reliability, adapted for forming a thin structure and capable of resolving the above mentioned drawbacks.

SUMMARY OF THE INVENTION

The object of the present invention is to reduce the discharge in the image forming apparatus, to reduce the damage in case of such discharge, and to increase the freedom in designing the image forming apparatus.

The above-mentioned object can be attained, according to the present invention, by an image forming substrate having an image forming member, featured in that a lead wiring connected to the image forming member is provided at a corner of the substrate.

According to the present invention, there is also provided an electron source substrate provided with plural electron-emitting devices and drive wirings for driving such plural electron-emitting devices, featured in having a penetrating hole in a position other than those of the drive wirings.

According to the present invention, there is also provided an image forming apparatus having an image forming substrate, an electron source substrate and an outer frame positioned between the substrate, wherein the image forming substrate is the above-mentioned image forming substrate and the electron source substrate is the above-mentioned electron source substrate.

DETAILED DESCRIPTION OF THE PREFERRED EMBODIMENTS

The present invention provides an image forming substrate having an image forming member, featured in that a lead wiring connected to the image forming member is provided at a corner of the substrate.

The present invention also provides an electron source substrate provided with plural electron-emitting devices and driving wirings for driving the plural electron-emitting devices, featured in having a penetrating hole in a position other than those of the drive wirings.

The present invention also provides an image forming apparatus in which the above-mentioned image forming substrate and the above-mentioned electron source substrate are positioned across an outer frame.

The present invention will now be clarified in detail by preferred embodiments thereof.

At first an embodiment of the present invention will be explained with reference to FIGS. 1, 2, 3A to 3E and 4.

Figure 1:
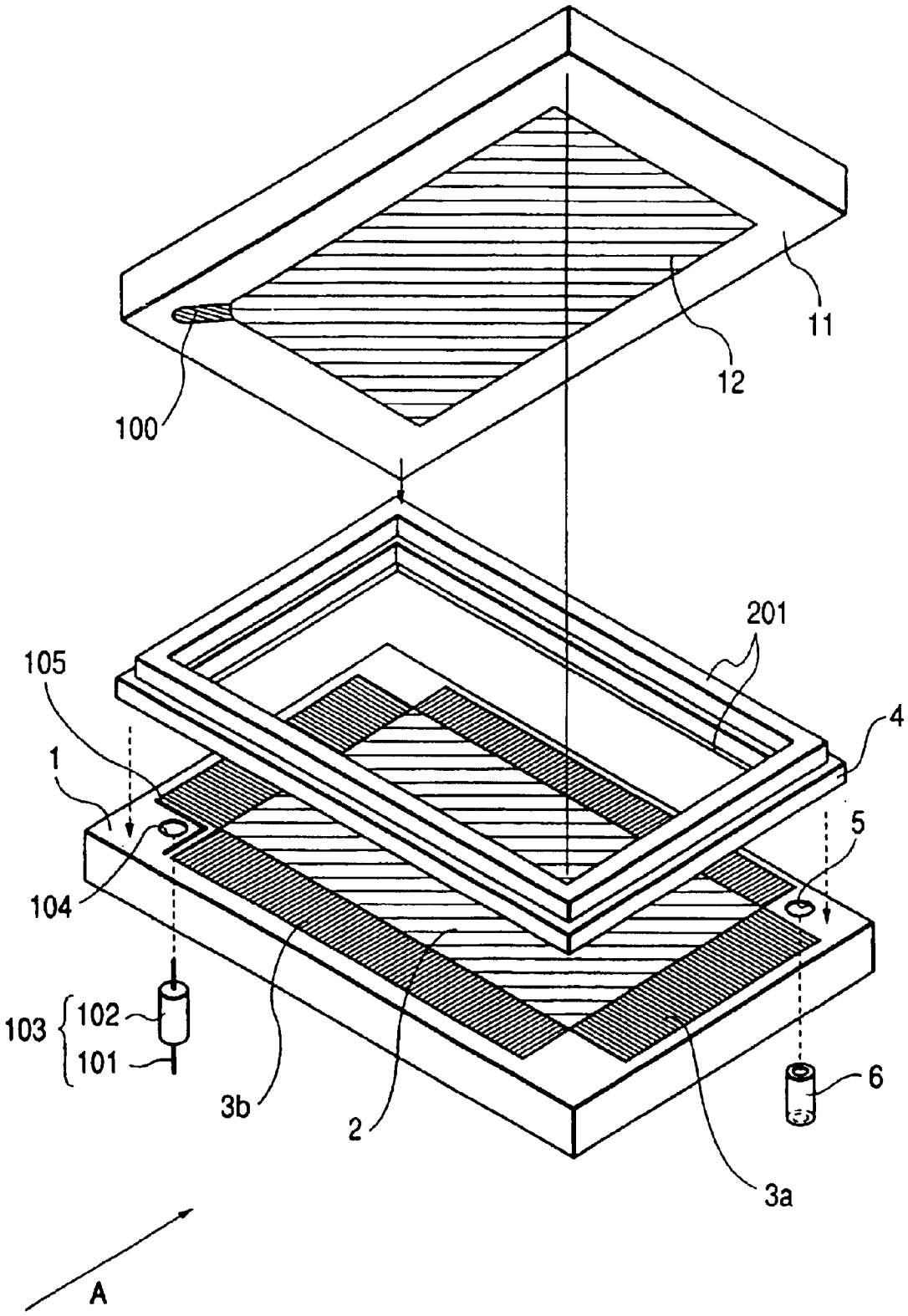
FIG. 1 is an exploded perspective view schematically showing an example of the configuration of the image forming apparatus of the present invention.
Figure 2:
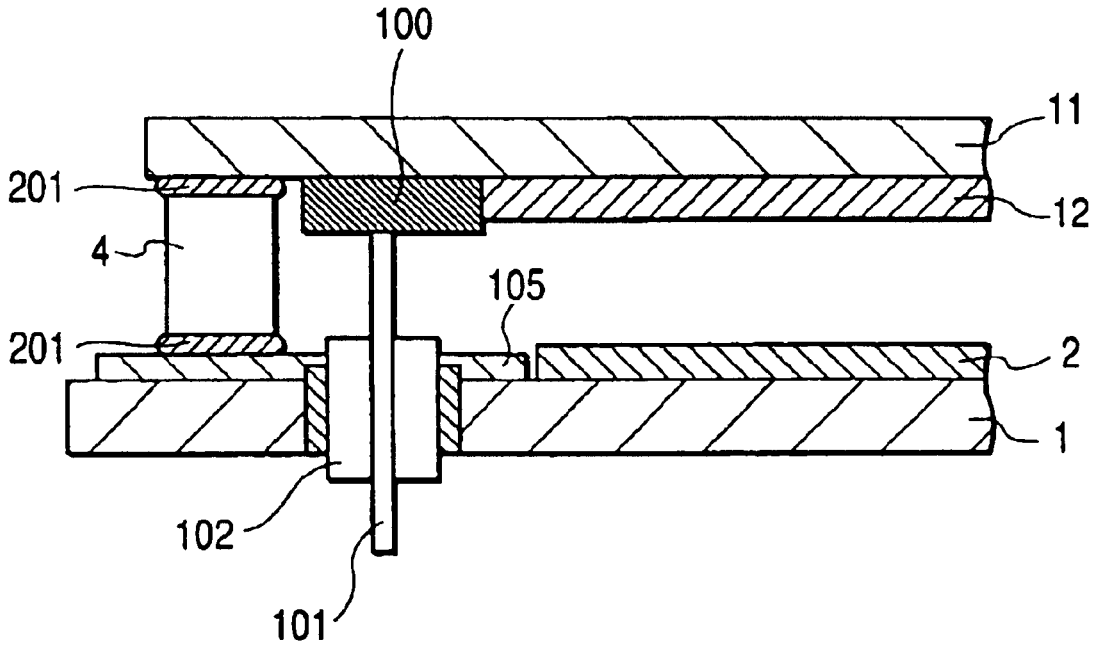
FIG. 2 is a cross-sectional view seen from a direction A in FIG. 1 and particularly showing the cross section of an anode terminal portion.

FIG. 1 is an exploded perspective view schematically showing an example of the configuration of the image forming apparatus of the present invention, and FIG. 2 is a partial cross-sectional view showing an anode terminal portion, seen from a direction A in FIG. 1. FIGS. 3A to 3E are views showing steps for preparing a rear substrate and illustrating a part of the electron source area, and FIG. 4 is a plan view showing an anode terminal portion and a peripheral area of the rear plate.

In FIGS. 1, 2, 3A to 3E and 4, there are shown a rear plate 1 serving also as a substrate for constituting an electron source; and an electron source area 2 in which electron-emitting devices such as field emission devices or surface conduction electron-emitting devices are provided in plural units and are connected to wirings for driving such devices according to the desired purpose. Such wirings for driving the electron sources are taken out by lead wiring portions 3*a*, 3*b* to the exterior of the image forming apparatus and are connected to a driving circuit (not shown) for the electron sources.

There are also shown a face plate 11 on which an image forming member is formed; an image forming member 12 having a fluorescent member capable of light emission by the electrons emitted from the electron source area 2; a lead wiring 100 composed for example of Ag and extracted for supplying the image forming member 12 with a voltage; an outer frame 4 sandwiched between the rear plate 1 and the face plate 11; and electron source drive wiring lead portions 3*a*, 3*b* which are extracted to the exterior through the adhered portion of the outer frame 4 and the rear plate 1 in a state embodiment for example in low-melting glass (frit glass 201).

The rear plate 1, face plate 11 and outer frame 4 can be composed of various materials according to various conditions, such as iron-containing glass, iron-containing glass with a surfacial $SiO_2$ film, low-Na glass or quartz glass.

There are also shown a line 101 for introducing the voltage supplied from an external high voltage source; and a rod-shaped insulating member 102 integrally molded with the introducing line 101 at the center and hermetically sealed therewith by a solder material such as of Ag—Cu or Au—Ni.

The insulating member 102 is composed of a material having the thermal expansion coefficient close to that of the rear plate 1, for example a ceramic material such as alumina or low-Na glass and also having insulating property capable of withstanding a high voltage, thereby preventing cracking in the adjoining part of the insulating member 102 and the rear plate 1, resulting from the difference in thermal expansion at a high temperature. However such configuration of the high voltage terminal is not restrictive and there may be adopted other configurations.

In order to ensure secure connection between the introducing line 101 and the lead wiring 100, there may be provided a connection member such as Ag paste or a mechanical spring structure between the introducing line 101 and the lead wiring 100.

A hole 104 is formed in the rear plate 1 for fitting a hermetic introduction terminal 103. The hermetic introduction terminal 103 and the penetrating hole 104 formed in the rear plate 1 are fixed with an adhesive member capable of hermetic sealing, such as frit glass 201. The penetrating hole 104 is formed in one of the four corners where the driving lead wirings 3*a*, 3*b* are not formed and inside the outer frame 4.

Also as a countermeasure against the discharge when the high voltage of several kilovolts is applied through the introducing line 101, a guard wiring 105 is formed outside the drive lead wirings 3*a*, 3*b* whereby the eventually generated discharge is guarded by the guard wiring 105 and the discharge current is prevented from flowing into the electron source area through the drive lead wirings 3*a*, 3*b* and from causing damages such as deterioration of the devices.

However the distance from the guard wiring to the introducing line 101 along the surface should be at least 1 mm. Instead, the frequency of discharge may increase if the distance to the guard wiring is extremely short.

There are also provided an evacuating hole 5 and a glass tube 6 provided in a position corresponding to the evacuating hole 5, connected to an external evacuation apparatus and to be sealed off after the evacuation process for forming the electron-emitting devices is completed. However, the glass tube 6 and the evacuating hole 5 mentioned above may be dispensed with if there is adopted a method of assembling the image forming apparatus in a vacuum apparatus.

The kind of the electron-emitting device constituting the electron source employed in the present invention is not particularly limited if the properties such as the electron-emitting characteristics and the device size meet the requirements of the intended image forming apparatus, and there can be employed the hot electron-emitting device or the cold electron-emitting device such as the field emission device, semiconductor electron-emitting device, MIM electron-emitting device or surface conduction electron-emitting device. The surface conduction electron-emitting device showing the following examples is advantageously adopted in the present invention and is similar to that described in the Japanese Patent Application Laid-Open No. 7-235255 of the present applicant.

In the following the present invention will be clarified further by examples.

EXAMPLE 1

In the following an example 1 will be explained with reference to FIGS. 1, 2, 3A to 3E and 4.

In the present example, FIG. 1 shows a rear plate 1 composed of iron-containing glass and bearing an electron source; and an electron source area 2 consisting of the surface conduction electron-emitting devices described in the Japanese Patent Application Laid-Open No. 7-235255 arranged in a matrix.

Drive wirings are extracted in four directions X, Y to the exterior of the image forming apparatus by drive wiring lead portions 3*a*, 3*b* formed by a printing process, and such lead portions 3*a*, 3*b* are connected to an electron source driving circuit (not shown) through a flexible cable (not shown).

In the present example, there are also provided a face plate 11 composed of iron-containing glass and bearing an image forming member 12; and a lead wiring 100 formed by printing Ag and extracted from a corner of the image forming member 12, in a position capable of contacting the introducing line of the high voltage terminal, introduced through the penetrating hole formed in the rear plate 1. The lead wiring 100 is so printed as to overlap with the image forming member 12 to ensure electrical conduction therewith.

The image forming member 12 is composed of striped fluorescent members, black stripes and a metal back. The fluorescent members and the black stripes are formed by printing, and an A1 film is formed thereon by vacuum evaporation as the metal back.

An outer frame 4 is composed of iron-containing glass and is sandwiched between the rear plate 1 and the face plate 11. The drive wiring lead portions 3*a*, 3*b* are extracted to the exterior, in the adjoining part between the outer frame 4 and the rear plate 1, by being embedded in frit glass 201, consisting of LS3081 manufactured by Japan Electric Glass Co. There are also provided an introducing line 101 consisting of an alloy 426; an insulating member 102 consisting of alumina ceramics and integrally molded with the introducing line 101 which is in advance soldered by Ag—Cu and subjected to vacuum hermetic sealing; and a penetrating hole 104 for introducing the insulating member 102 in which the introducing line 101 is integrally sealed hermetically. The position of the penetrating hole 104 will be explained later.

In the following there will be explained the process for preparing the rear plate 1, with reference to FIGS. 1, 3A to 3E and 4.

(Step a)

On a rinsed iron-containing glass plate, an $SiO_2$ layer of a thickness of 0.5 $\mu$m is formed by sputtering to obtain the rear plate 1. Then an ultrasonic working machine is used to form the circular penetrating hole 104 of a diameter of 7 mm for introducing the high voltage introducing terminal. The penetrating hole is positioned, as shown in FIGS. 1 and 4, in a corner outside the electron source area 2 and the drive wiring lead portions 3*a*, 3*b*, with the center of the hole at a distance of 7 mm from a guard wiring to be explained later.

On such rear plate, device electrodes 21, 22 of the surface conduction electron-emitting devices are formed by sputtering and photolithographic process. The electrodes were composed of Ti of a thickness of 5 nm and Ni of a thickness of 100 nm, deposited in succession. The device electrodes had a distance of 2 $\mu$m (cf. FIG. 3A).

(Step b)

Then Ag paste is printed in a predetermined shape and sintered to form Y-direction wirings 23, which are extended to the exterior of the electron source area to constitute the electron source driving wirings 3*b* shown in FIG. 1. The wiring had a width of 100 $\mu$m (cf. FIG. 3B). At the formation of the above-mentioned Y-direction wirings 23, there is simultaneously formed a guard wiring 105 shown in FIG. 4.

(Step c)

Then an insulating layer 24 is formed by printing a paste material composed of principally PdO and glass binder. This layer was formed with a thickness of about 20 $\mu$m, in order to insulate the Y-direction wirings 23 from X-direction wirings to be explained later. In a position corresponding to the device electrode 22, there is formed a notch 24*c* for enabling connection between the X-direction wiring and the device electrode 22 (cf. FIG. 3C).

(Step d)

Then X-direction wirings 25 are formed on the insulating layer 24 (cf. FIG. 3D), with a process same as that for the aforementioned Y-direction wirings, with a width of 300 $\mu$m and a thickness of about 10 $\mu$m. These wirings are extended to the exterior of the electron source area and constitute the electron source driving wirings 3*a* shown in FIG. 1.

Figure 3A:
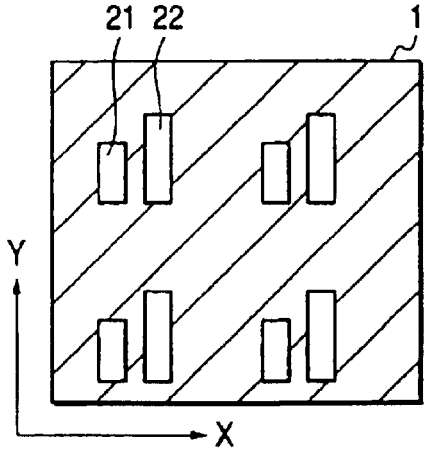
FIGS. 3A, 3B, 3C, 3D and 3E are views showing the steps for preparing a rear plate substrate.
Figure 3B:
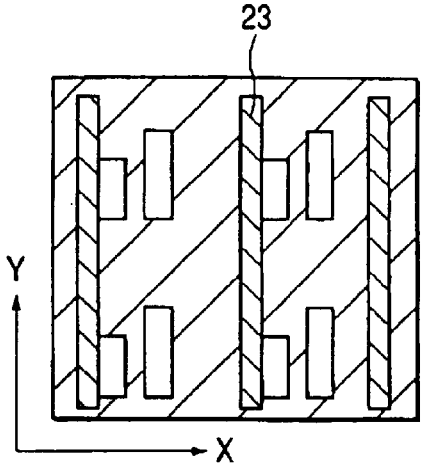
Figure 3C:
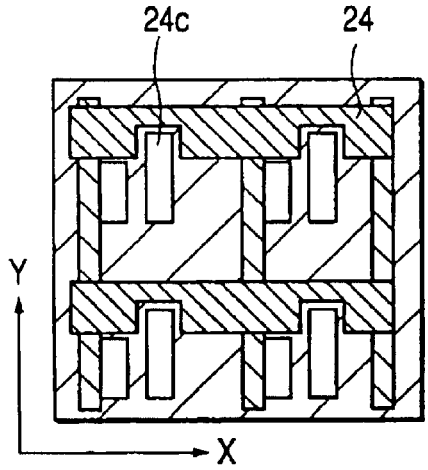
Figure 3D:
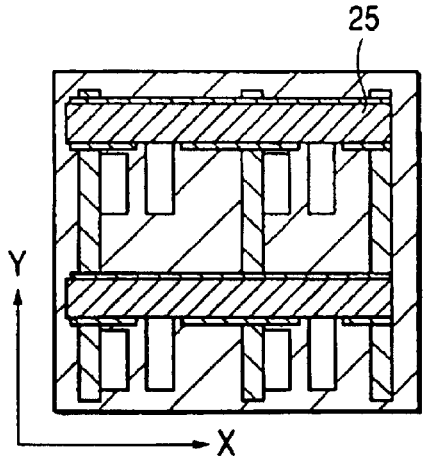
Figure 3E:
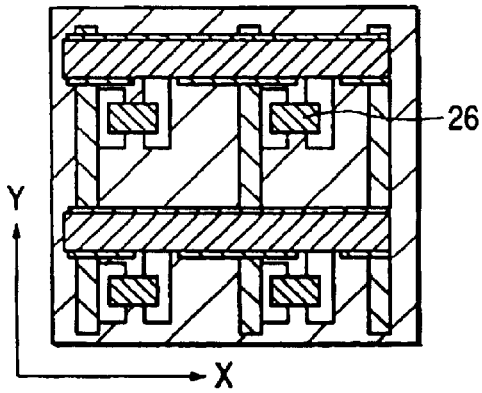
Figure 4:
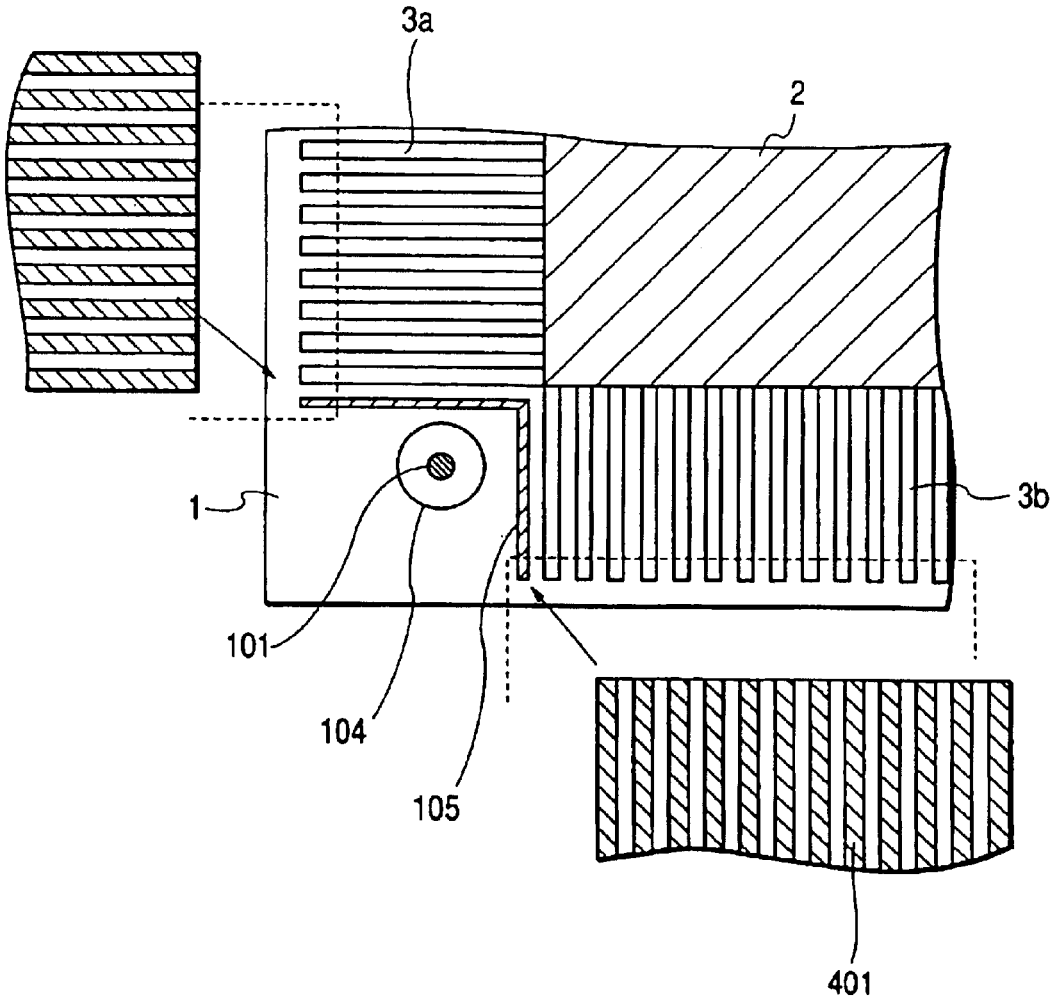
FIG. 4 is a plan view showing an anode terminal portion and a peripheral area of the rear plate.

Then organic Pd solution is coated and baked for 12 minutes at 300° C. in the ordinary atmosphere to form a conductive PdO film 26 (cf. FIG. 3E).

The rear plate 1 prepared through the above-described process has wiring-free areas only in the four corners as shown in FIGS. 1 and 4, the guard wiring 105 outside the drive wiring lead portions 3*a*, 3*b* in one corner, and the penetrating hole 104 at a distance of 7 mm from the guard wiring 105, so as to be opposed to the lead wiring 100 of the face plate 11. At the assembling operation, the plates are carefully so aligned that the unrepresented fluorescent members of the image forming member 12 of the face plate 11 respectively correspond to the electron-emitting devices of the rear plate 1.

After the installation of the hermetic introduction terminal 103 and the glass tube 6 and after the above-described alignment, the assembled members are placed in an unrepresented oven and are heated at 420° C. to fuse the frit glass 201 positioned at the contacting portions of the face plate 11, the rear plate 1 and the outer frame 4. Thereafter the members are cooled to complete the assembling. In this state the face plate 11, rear plate 1, outer frame 4, glass tube 6 and hermetic introduction terminal 103 forms a panel that can be subjected to an evacuation process.

Thereafter an unrepresented evacuation apparatus is connected to the glass tube 6 to evacuate the interior of the panel, and a forming process and an activation process are executed on the conductive film 26. Then, under the continuation of the evacuation, the panel is subjected to baking to eliminate the organic molecules remaining in the vacuum panel. Finally the glass tube 6 is sealed off by heat fusing. The vacuum panel is completed through the above-described process.

Then, for connecting the drive wiring lead portions 3*a*, 3*b* with a driving board and connecting the guard wiring 105 with an external ground terminal, FPC (flexible printed circuits) 401 are electrically connected and fixed in positions indicated by arrows and broken lines in FIG. 4, by means of an external FPC connecting apparatus. The image forming apparatus is completed by incorporating the vacuum panel in a casing and connecting the FPC with circuit boards. In this operation, as the connecting operation of the introducing line 101 of the hermetic introduction terminal 103 and the high voltage source could be realized without interfering with the FPC 401, since the introducing line is derived from a corner on the rear face of the vacuum panel.

The above-described image forming apparatus, in an image displaying operation under the supply of the high voltage and of an external image signal from an image drive circuit, was capable of stable image display for a prolonged period without detrimental effects such as discharge.

The above-described configuration is capable of providing an image forming apparatus with advantages that:

1. The cabling of the high voltage terminal is facilitated in assembling the vacuum panel into the casing. More specifically, in placing the driving circuit board at the rear face side of the vacuum panel, it is necessary to secure a spatial distance in the positioning of the high-voltage cable in consideration of the discharge, but the high-voltage cable positioned at the corner facilitates such securing of the spatial distance and increases the freedom of designing;
2. In forming the matrix wirings on the rear plate, symmetrical design is rendered possible to facilitate designing and is convenient in the apparatus for constituting such wirings; and
3. Such configuration is safer for the discharge, since the driving wirings are absent in the corner portion and also since the guard wiring is provided.

EXAMPLE 2

The present example will be explained with reference to FIGS. 5, 6A to 6C, 7 and 8A to 8C.

Figure 5:
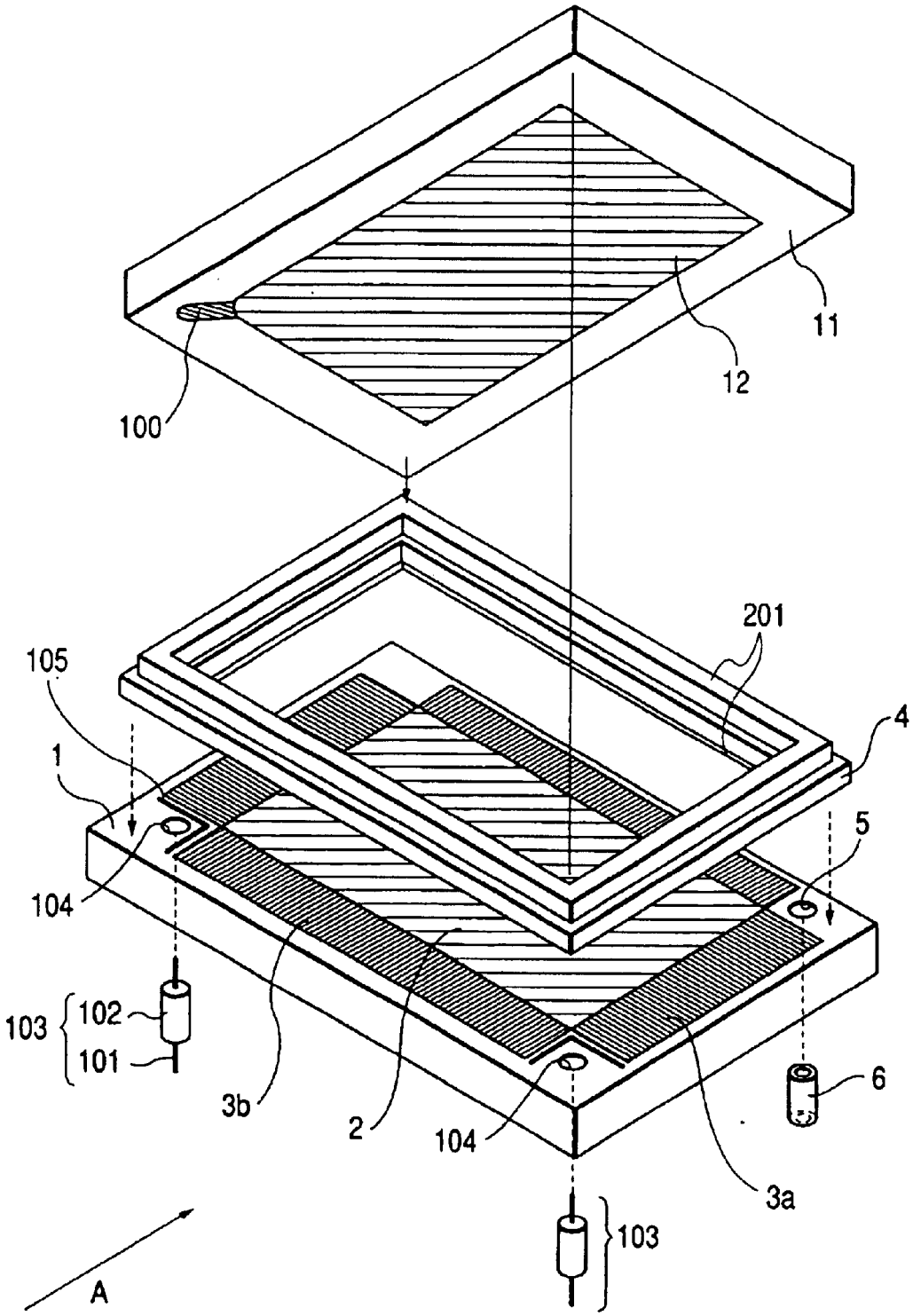
FIG. 5 is an exploded perspective view schematically showing an example of the configuration of an image forming apparatus constituting an embodiment 2.
Figure 6A:
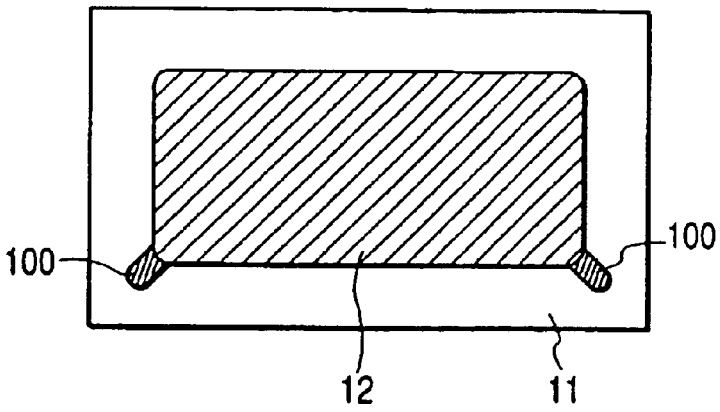
FIGS. 6A, 6B and 6C are views showing various configurations of a lead wiring of a face plate 11.
Figure 6B:
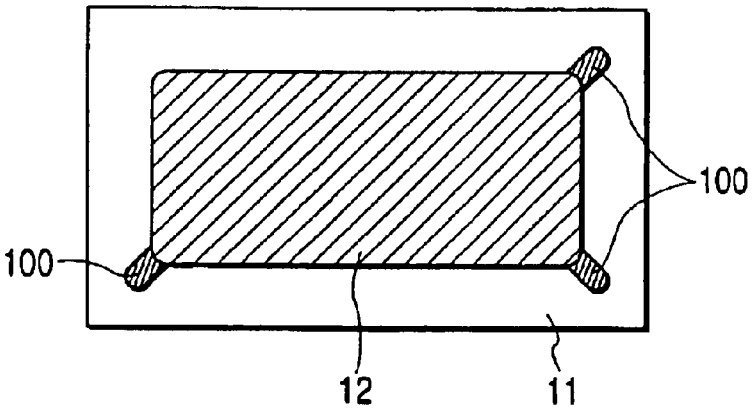
Figure 6C:
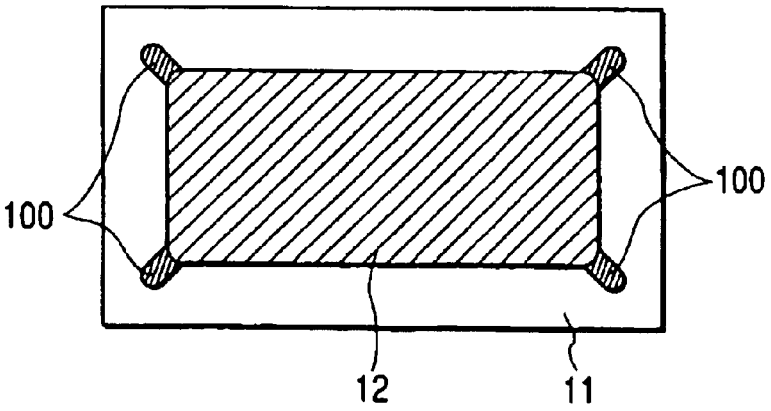
Figure 7:
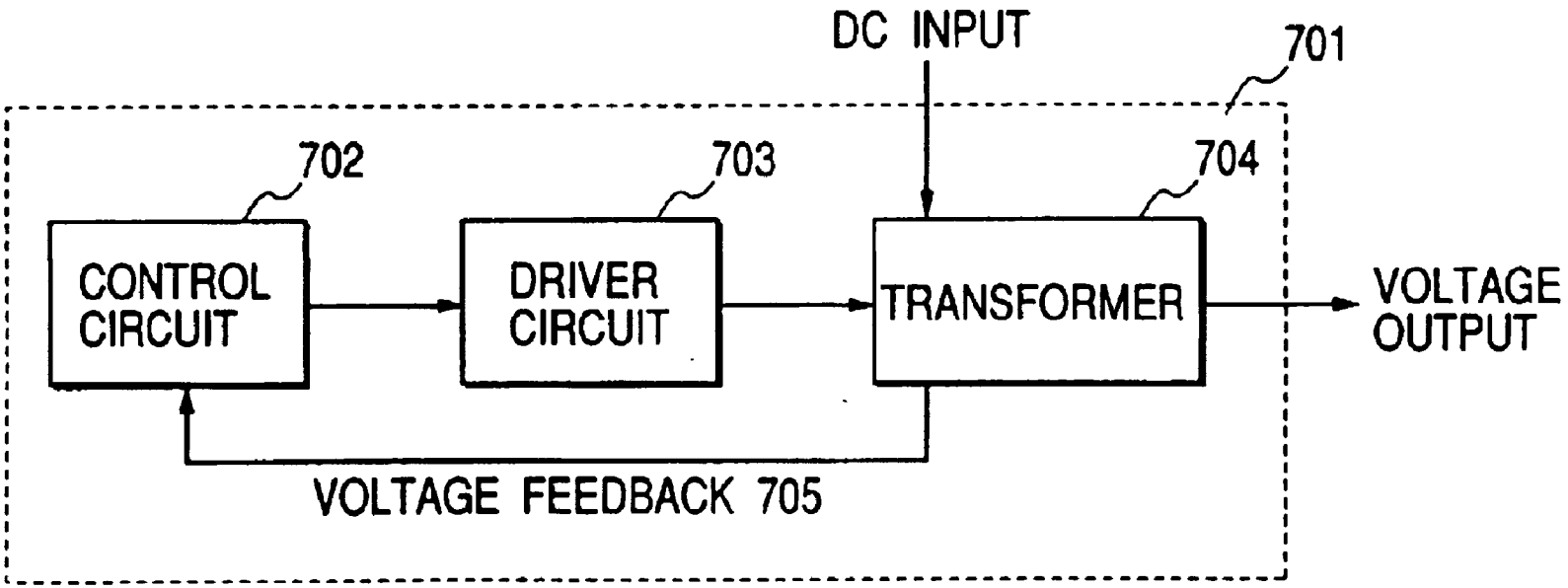
FIG. 7 is a block diagram of a high voltage power source for supplying a high voltage.
Figure 8A:
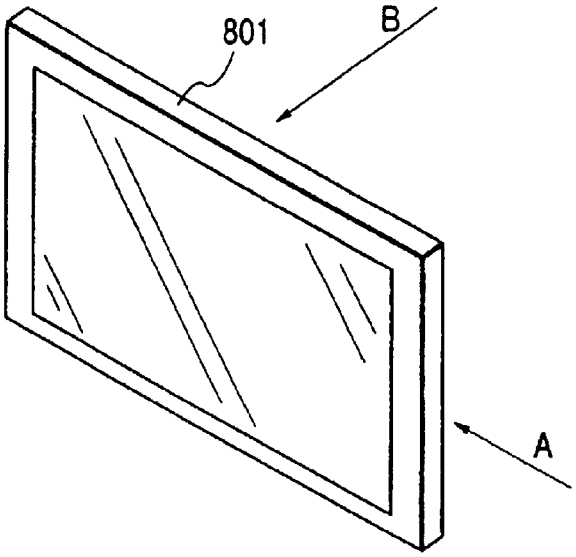
FIGS. 8A, 8B and 8C are views showing the internal structure of an envelope.
Figure 8B:
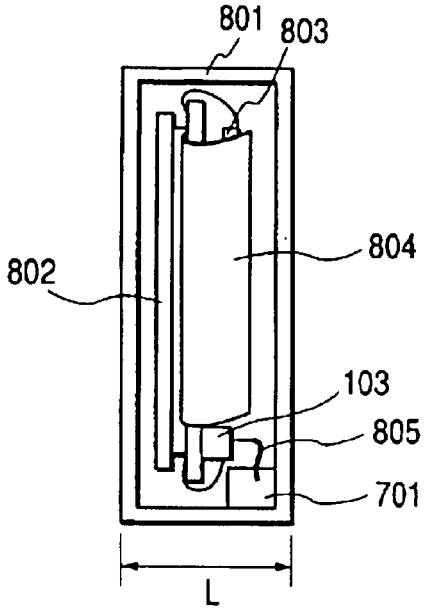
Figure 8C:
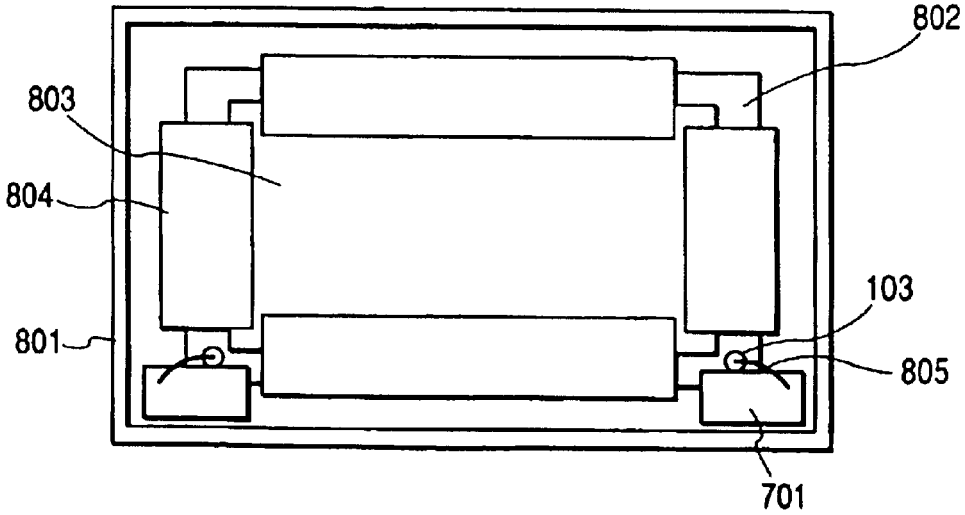

FIG. 5 is an exploded perspective view schematically showing an example of the configuration of the image forming apparatus of the present example; FIGS. 6A to 6C are views showing various configurations of the lead wiring of the face plate 11; FIG. 7 is a block diagram showing the configuration of a high voltage source for supplying the high voltage; and FIGS. 8A to 8C are views showing the internal structure of the casing.

The configuration of this example is provided with plural high voltage terminals, and two hermetic introduction terminals 103 are positioned in penetrating holes 104 provided at two corners of the rear plate 11 as shown in FIG. 5. In this case, the face plate 11 is provided, as shown in FIG. 6A, with the lead wirings in two corners. However such configuration is not restrictive, and the lead wirings may be provided in three or four corners as shown in FIG. 6B or 6C. In the present example, components equivalent to those in the foregoing examples are represented by same numbers and the configuration and the preparing method for such components will not be explained further.

For image formation by the supply of high voltage to the above-described high voltage terminals, there is required a high voltage source which will be explained in the following with reference to FIGS. 7 and 8A to 8C.

In FIG. 7 there are shown a high voltage source 701; a control circuit 702; a drive circuit 703; a transformer 704; and a voltage feedback circuit 705 for stabilizing the output voltage.

FIGS. 8A to 8C illustrate the structure of the casing; wherein FIG. 8A is an external view showing the members in FIGS. 6A to 6C and 7 assembled in the interior of the apparatus, while FIG. 8B is a cross-sectional view showing the structure of the interior of the casing seen from a direction A, and FIG. 8C is a view seen from a direction B, with the rear plate of the casing 801 being removed. There are shown a vacuum panel 802 of the display device; a driving board 803 for driving the vacuum panel 802; an FPC 804 electrically connecting the vacuum panel 802 and the driving board 803; and a high voltage wiring 805 connecting the high voltage source 701 and the hermetic introduction terminal 103.

A voltage is supplied from an unrepresented DC source in the image forming apparatus to the transformer 704 in the high voltage source 701. The input DC voltage is elevated by the transformer 704 to a desired high output voltage. In order to suppress the fluctuation in the output voltage, it is fed back through a feedback circuit 705, controlled by the control circuit 702 and supplied through the drive circuit 703 to the transformer 704. The present example employed a voltage of 10 kV with a current of 10 mA. In the high voltage source 701 for outputting such voltage, the transformer 704, if constituted as a single unit, has a core diameter of about 50 mm, but can reduce the core diameter if constituted as plural units. For example, if the transformer is composed of two units, the external diameter of the core can be reduced to about 30 mm since the current to be supplied by each unit is reduced to ½. Similarly, in case of four units, the current is reduced to ¼ so that the core diameter can be reduced to about 25 mm. Thus the transformer 704 and the high voltage source 701 can be made thinner by reducing the core diameter. As will be apparent from FIG. 8C which is the cross-sectional view of the image forming apparatus 801 seen from the direction A, a thinner high voltage source 701 can reduce the depth L of the entire image forming apparatus. As the hermetic introduction terminals 3 are positioned at the corners, the high voltage sources 701 are positioned at the corners of the casing 801 close to the hermetic introduction terminals 103, in consideration of the ease of wiring.

As explained in the foregoing, the entire apparatus can be made thinner by positioning the high voltage terminals in plural units at the corners of the vacuum panel and constituting the high voltage source by plural units. Also the use of plural hermetic introduction terminals reduces the inclination in the luminance. Such configuration is advantageous in forming the display of a large area.

EXAMPLE 3

The present example will be explained with reference to FIGS. 9A and 9B.

Figure 9A:
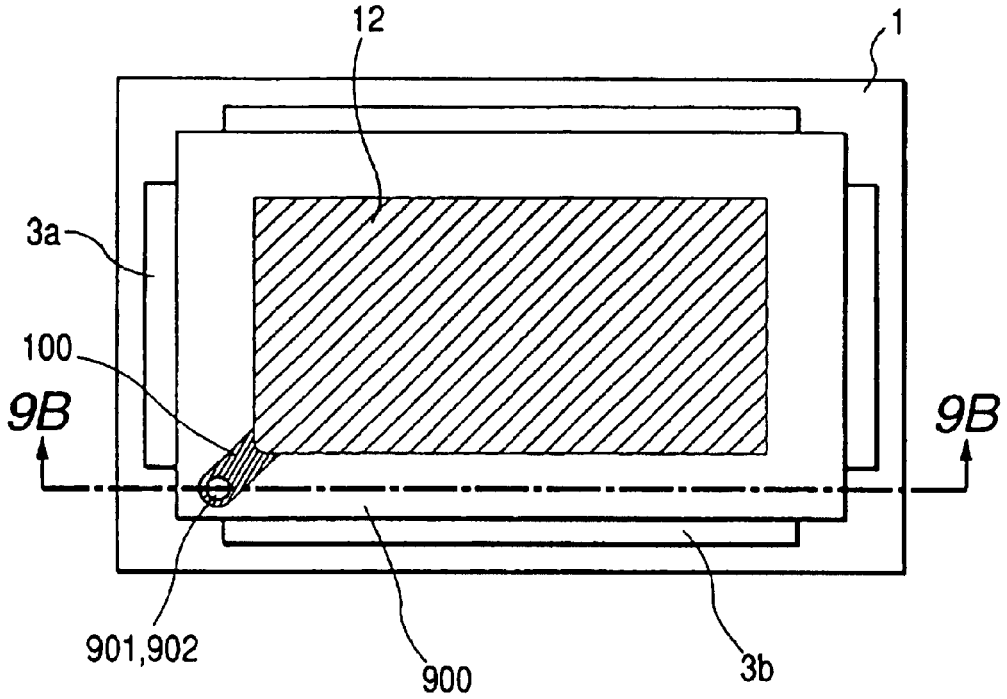
FIG. 9A is a plan view of a vacuum panel of an embodiment 3 seen from the side of the face plate.
Figure 9B:
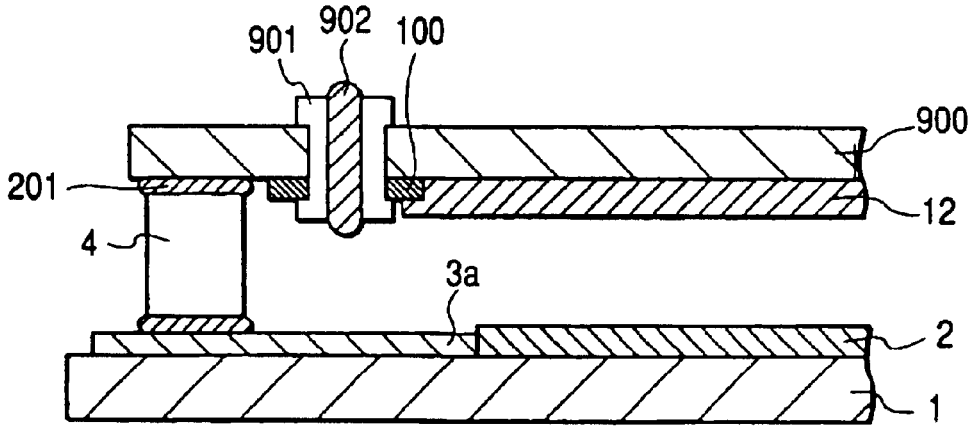
FIG. 9B is a cross-sectional view, along a line 9B—9B in FIG. 9A, showing a high voltage terminal and a peripheral area thereof.

FIG. 9A is a plan view of a vacuum panel of the present example, seen from the side of the face plate, and FIG. 9B is a cross-sectional view in the vicinity of the high voltage terminal structure, seen along a line 9B—9B in FIG. 9A. Components similar to those in the foregoing examples are represented by same numbers, and the configuration and preparing method for such components will not be explained further.

In this example, the high voltage lead portion is formed on the face plate. As shown in FIGS. 9A and 9B, a penetrating hole of a diameter of 1 mm is formed in the face plate 900 at the center in the width of a lead wiring 100 in order to secure electrical conduction therewith and a conductive member 901, consisting of Ag paste is formed on the internal periphery of the penetrating hole, and a seal member 902 consisting of frit glass is filled in the hole to ensure hermeticity. Such configuration is advantageous against the discharge, since there can be secured the distance to the electrodes such as the printed wiring formed on the rear plate 1.

The configuration of the image forming apparatus of the present invention is not limited to those disclosed in the foregoing examples, but may be subjected to various modifications within the scope and spirit of the appended claims.

As explained in the foregoing, the image forming apparatus of the present invention provides the following excellent effects.

Firstly, there can be facilitated the cabling operation in assembling the panel into the casing. Also in case of positioning the driving circuit board at the back side of the vacuum panel, it is necessary to secure a spatial distance to the high voltage cable in consideration of the discharge, but the high voltage terminal at the corner portion facilitates securing the spatial distance and increases the freedom in designing.

Also in forming the matrix wirings on the rear plate, symmetrical design is rendered possible to facilitate designing and is convenient in the apparatus for constituting such wirings.

Also the apparatus is resistant to the discharge, because of positioning of the high voltage terminal and the penetrating hole at the corner and presence of the guard writing.

Furthermore, the use of plural high voltage terminals and plural power sources allows to form the entire image forming apparatus thinner. Also the use of plural high voltage terminals allows to provide stable image quality with reduced inclination of the luminance, even in the display of a large area.

What is claimed is:

1. An image forming apparatus comprising:

a first substrate on which a plurality of electron-emitting devices and drive wiring for driving said plurality of electron-emitting devices are arranged; and a second substrate on which an image forming member and lead wiring connected to said image forming member are arranged, wherein said first and second substrates are disposed in opposition to each other, and said plurality of electron-emitting devices, said drive wiring, said image forming member and said lead wiring are disposed within an envelope constructed of said first and second substrates, and wherein said lead wiring extends to a corner of said second substrate and is in contact with an electroconductive terminal, and said electroconductive terminal extends from a contact portion with said lead wiring toward said first substrate and is partially exposed outside of the envelope through an opening formed in said first substrate; and a wiring of a defined potential is disposed between the opening and said driving wiring in the envelope.

2. The apparatus according to claim 1, wherein said wiring of a defined potential is a ground line.

* * * * *

UNITED STATES PATENT AND TRADEMARK OFFICE

CERTIFICATE OF CORRECTION

PATENT NO. : 6,954,030 B2
APPLICATION NO. : 10/751933
DATED : October 11, 2005
INVENTOR(S) : Toshimitsu Kawase It is certified that error appears in the above-identified patent and that said Letters Patent is hereby corrected as shown below:

COLUMN 2:

Line 40, “eventually” should read --eventual--.

Signed and Sealed this

First Day of August, 2006

JON W. DUDAS
*Director of the United States Patent and Trademark Office*